US005980161A

United States Patent [19]

Degen et al.

[11] Patent Number: 5,980,161

[45] Date of Patent: Nov. 9, 1999

[54] DEVICE FOR PROVIDING COLUMNS OF MATERIAL IN THE GROUND

[76] Inventors: Wilhelm Degen, Bürgeli 1, CH-8864 Reichenburg/SZ, Switzerland; Alexander Degen, Hassenham 8, D-84419 Schwindegg, Germany

[21] Appl. No.: 09/031,230

[22] Filed: Feb. 26, 1998

[30] Foreign Application Priority Data

Feb. 26, 1997 [DE] Germany ..... 197 07 687

[51] Int. Cl.[6] ..... E02D 7/26; E02D 7/02

[52] U.S. Cl. ..... 405/232; 405/233

[58] Field of Search ..... 405/232, 233

[56] References Cited

U.S. PATENT DOCUMENTS 5,256,003 10/1993 Ito et al. .

5,647,690 7/1997 Landau ..... 405/233 X

FOREIGN PATENT DOCUMENTS 22 60 473 6/1974 Germany .

OTHER PUBLICATIONS

Patent Abstracts of Japan, vol. 8, No. 28 (M–278) and JP 58 185819 (Yoshinori) entitled "Crushed Stone Piling Work"; Feb. 7, 1984.

Holeyman, "Uitvoering van de grondverberering", Viviele Techniek, Bd. 39, Nr. 3, Mar. 1984, (Rijswijk, Netherlands).

*Primary Examiner*—David Bagnell

*Assistant Examiner*—Sunil Singh

*Attorney, Agent, or Firm*—Pendorf & Cutliff

[57] ABSTRACT

Device for production of material columns in the ground, in particular of compact columns or drains, with a apparatus carrier (10), a sled (14) movably guided upon a Makler (12) for manipulation of a conveyor system, comprising at least of a deep jolt ramming machine (16) with forward thrust head and material conveyance conduit, and a cantilever beam (20) held by the Makler (12) with a rope winch (22) for manipulating a container (26), with which material can be charge wise supplied to a charge lock (18), wherein the container (26) is synchronized with and is moveable relative to the sled (14). The material flows from the charge lock (18) through a lock door (21) into the material conveyance conduit (17) and from there finally into the ground (100).

15 Claims, 1 Drawing Sheet

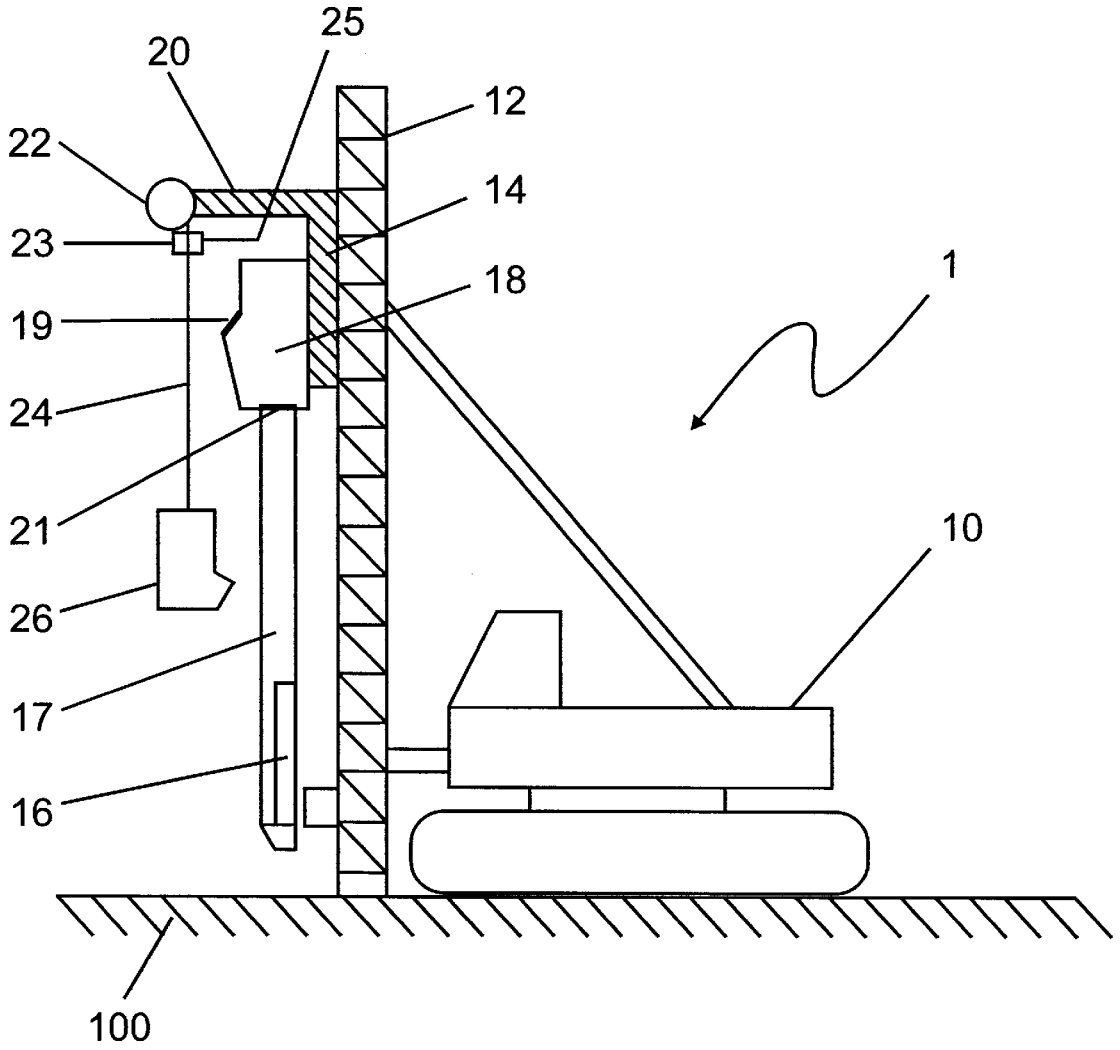
25
20
12
22
14
23
18
1
19
24
21
10
26
17
16
100

DEVICE FOR PROVIDING COLUMNS OF MATERIAL IN THE GROUND

BACKGROUND OF THE INVENTION

1. Field of the Invention

The invention concerns a device for providing columns of material in the ground, in particular packed material columns or drains.

2. Description of the Related Art

A comparable device is basically known from DE 22 60 473 C2. This includes a lifting device in the form of a movable crane. The lifting device serves for manipulating a conveyor system for constructing columns of material, which is comprised of a deep jolt ramming machine or another type of forward thrust head and a material conveyance conduit. With the help of the forward thrust head first a borehole is formed downwardly and this is subsequently filled with material. Depending upon the task at hand, the construction can be formed or configured in various ways. For production of drains, the material is loosely filled, so that a comparatively large porous space remains between the material particles. On the other hand a strongly compacted construction can be achieved, wherein the materials is strongly, and with sideways compression, packed.

In each case the fill material is supplied from above via the material conveyance tube or conduit wherein the entire conveyance system, that is, inclusive of the material conveyance conduit, is placed under positive pressurization, on the one hand to prevent penetration of water or earth material into the hollow space excavated by the boring or tunneling unit comprised of the material conveyance conduit and the forward thrust head, and on the other hand, to assure an emission of material underground.

The filling material is provided to the conveyor system in a charge-wise manner by means of a container and, more particularly, by feeding at the upper end of the material conveyor conduit. For manipulating of the container a rope or cable winch is provided, which is provided on the cantilevered beam of the lifting device in a known manner. Therewith it is possible, on other one hand, to set the container on the ground in order that it, while there, can be filled with available material. On other hand it can be lifted to the upper end of the material conveyor conduit, in order to feed or charge this with fill material.

In accordance with a further already in use development of the above-described device, a so-called Makler or rigging is used in place of the crane. Here we refer to a vertical mast, upon which a sled is moveably mounted, guided upon guide rails. The sled serves for manipulation of a transport system of the category discussed above.

The Makler further carries on its upper end a cantilever beam provided with a rope winch for manipulating the container. Makler and cantilever beam thus together form one constructive unit.

The manipulation of the conveyor system on the one hand and the container on the other hand are possible independently of each other. So the sled, and therewith the ramming machine, can be moved up and down in steps of approximately 0.5 m to 1.0 m. During the respective upwards movement fill material is emitted from the tip of the ramming machine. During the respective subsequent downward movement the material is packed sideways and also partially towards downwards into the ground. In this manner the so-called compact columns are formed.

Independent of the movement of the boring or sinking unit and the sled with charging lock or lock, the rope or cable winch is used to respectively lower the container to the ground, fill it with material and subsequently raise it again.

For charging the supply system with fill material it is necessary that the sled be halted so that the container can be docked to the supply conduit and be emptied. It is thus necessary that the jolt-ramming machine be halted at intervals, in order that the respective charge of material can be introduced. In the entirely conventional case a 10 m long gravel column with a column diameter of 0.8 m would require a gravel volume of 5 $m^3$. Considering a useable volume of the container in the order of approximately 1 $m^3$ there would thus be a requirement for five charges, which would lead to the necessary frequent interruptions in the production process.

SUMMARY OF THE INVENTION

The invention is thus concerned with the problem, of improving a device of the type described in the introductory portion, so that the above-described disadvantages no longer occur. In particular it is desired, to so optimize the feeding or charging process, that the undesired interruptions be kept to a minimum.

The invention is based upon the idea of synchronizing the movement of the container with that of the conveyor system at least during the period of the feed or charging process. Thereby it becomes possible to empty the contents of the container without stopping the jolt ramming machine. Stoppage times as a result of the feeding or charging process no longer occur, so that the efficiency of production of material columns can be significantly increased.

Although a synchronization of this type can be accomplished in many various ways, it has been found to be particularly advantageous, when the cantilever beam is so designed or constructed, that it is moveable and engageably connected to the sled. A particularly simple construction results when the cantilever beam is directly secured to the sled. Solving the problem in this manner has the advantage, that it is particularly economical to produce and is absolutely reliable even in the most demanding conditions of use. For carrying out of the charge or feed process, it is basically necessary, that the container filled with material be lifted via the rope or cable winch and delivered to the feed or charge opening at the conveyor system, that is, to the material conveyance conduit. This is not associated with any difficulty, since the conveyor system and the rope or cable winch exhibit no relative movement with respect to each other. An approach to the feed opening essentially only requires the simple lifting of the rope or cable guiding the container, which is independent of the instantaneous position of the sled guiding the sinking or digging unit.

Further advantages are seen when in accordance with the further preferred embodiment the cantilever beam, when the sled is in its uppermost position, projects upwardly beyond the Makler. In this manner, even when maintaining the conventional Makler length, longer material columns can be produced, since the traversal path of the sled is no longer limited by the cantilever beam fixedly connected to the Makler. Better yet, the travel path of the sled can be utilized up to the end of the guide rails, which are extended up to the upper end of the Makler. Therewith an extending of the possible material column, for a given Makler length, of up to approximately 3 m is possible.

Preferably the rope winch is so constructed, that it can be switched to free of power or almost free of power, as long as the container is seated upon the ground. This operating condition makes possible the filling of the container, without having to uncouple this from the rope. The ropee during this time hangs loosely or with low tension on the container, even when the sled is moved upwardly.

The maintenance of a definitive pre-tensioning prevents a tangling of the loose rope on the winch drum and the temporary lying down of the rope upon the ground. A pre-tensioning force if this magnitude can be realized in a simple manner, for example by a still-stand electric motor.

After ending the refill process the rope winch is again engaged or connected and lifts the container.

It is preferred when the container is moveably guided on the Makler, preferably via rollers, which run upon rails. Unintentional swinging or pendulating movements of the container are therewith assuredly prevented.

Alternatively the synchronization can be achieved via a further preferred variation thereby, that in the sled or on the conveyance system an end-stop is provided, against which the container after being refilled with material is driven and there is held for the duration of the charging of the conveyor. For this the rope winch is provided with a device for limiting the pull force 23, for example in the form of a slip coupling. The pull force or lifting force is so selected, that it on the one hand lifts the container filled with material, on the other hand when positioned against the upper end stop still permits the up and down movement of the sled or as the case may be the conveyor system.

This solution provides a cost-effective variation with which the Makler described in the introductory portion, with rigidly connected cantilever beam, can be retrofitted. Beyond this, it is insured with this solution, that the rope remains under pretension while the container is docked at the conveyor system.

A further alternative is comprised therein, during a resting or inoperation of the rope winch, to so provide a governing arrangement 25, which has an effect upon this and insures the synchronization of the container with the sled or as the case may be the conveyor system. In this case the container filled with material is lifted and during the time of the feeding or charging moves up and down in synchrony with the conveyor system. Thus, care must be taken that the governor maintains the relative position of the container and the conveyor or, as the case may be, the sled, within a predetermined tolerance value, which is determined essentially by the design of the container in the area of the chute and the corresponding receptacle opening of the conveyor system, and lies between 0.1 m and 0.3 m.

Also, this alternative is envisioned especially as a retrofit possibility for the existing systems with fixed Makler and thereon provided cantilever beam.

According to a further variant there is, at the upper end of the deep jolt ramming machine or, as the case may be, the conveyor conduit, a feed lock, which makes it possible for the conveyor system to be charged without standing still, when the type of process described in the introductory portion, in which a positive pressurization in the area of the material outlet at the jolt ramming machine tip, is practiced.

The feed lock insures that the positive pressure existing therebelow within the conveyor conduit need not be reduced, in order to be able to refill material. Rather, the feed lock is closed off pressure tight with respect to the conveyance conduit for the duration of the feed or charge process. As soon the container is completely empty, the feed or charge lock is closed off pressure tight with respect to the environment, and the connection to the conveyor conduit can be opened. Depending upon the remaining air volume in the feed or charge lock, there may occur upon the opening of the connection to the conveyor conduit essentially a small pressure drop, which can be addressed without a problem by the supply of pressurized air to the conveyor conduit.

Insofar as a short time pressure drop of this type is to be completely avoided, in accordance with a further variant a compressed air supply for the feed or charge lock is provided independent of the pressure space or, as the case may be, supply conduit. Therewith a positive pressure can be built up in the charge lock prior to the opening of the connection to the conveyor conduit, which corresponds to the pressure existing in the therebelow situated pressure space. Therewith the pressure built up in the conveyor conduit remains at the desired level.

This embodiment is particularly valuable where the ground tends to be fluid, since even here small pressure differentials lead thereto that the ground enters into the material outlet and plugs this up. Even when this type of plugging can later be unplugged, this type of influx of ground is highly undesirable, since it leads to the contamination of clean column gravel with earth or ground. As a result the continuity of the load bearing ability or the drain effect of the column is placed into question in the deep area.

It is preferred to design or construct the charge or feed lock as a tank, of which the capacity corresponds at least to the conveyance volume of the container. Therewith it is possible, to dump the container contents in a single pass. It can be particularly advantageous when the tank has a capacity, such that it can receive multiple charges. Therewith it can serve as an intermediate storage area for the fill material, as a result of which the charge or feed process can be practically completely dissociated from the jolt ram process. Therewith it is also possible to avoid a period of inoperation of the equipment when the supply of fill material by the container happens to be interrupted for some unforeseeable reason.

In a special application (offshore-foundations) it can be desirable, when even the entire amount of gravel necessary for provision of the column is filled into a correspondingly large dimensioned tank prior to beginning of the production of the column, since the work depth lies so far under water, that the cumulative sinking or boring unit must travel through several tens of meters of water and as a result the supply of material via known techniques is impossible in this depth or at least is exceptionally cumbersome.

BRIEF DESCRIPTION OF THE DRAWINGS

The invention will now be discussed in greater detail with reference to the embodiment shown in the figure, wherein FIG. 1 shows a device for construction of material columns in the ground

DETAILED DESCRIPTION OF THE INVENTION

In the single figure a device 1 is presented, which is seated upon the ground 100 and is intended to produce a here not shown material column, for example in the form of a packed column or a drain.

The device 1 includes a mobile apparatus carrier 10 which receives or carries the collection of components. At the apparatus carrier 10 a Makler 12 (framework or rigging) is provided. The Makler is provided with here not shown guide rails for a sled 14, which is movable along the entire length of the Makler 12.

The sled 14 receives a known sinking or boring unit with deep jolt ramming machine 16 and material conveyance conduit 17 and serves for the manipulation thereof.

At the upper end of the sled 14 a cantilever beam 20 is provided, which on its end carries a rope winch 22. With the help of the rope winch 22 the container 26 is manipulated, which is secured via rope 24. Alternatively, the rope winch 22 can also be integrated in the container 26.

As a result of the rigid connection of the sled 14 and the cantilever beam 20 there is produced a forced-coupled movement of these two components. In the situation represented in the figure and with blocked rope winch 22 there results a simultaneous movement of container 26 and deep jolt ramming machine 16, the relative positions with respect to each other remain intact.

An upwards or downwards directed movement of the container 26 results relative to the deep jolt ramming machine 16 by operation of the rope winch 22, and this independent of the movement of the sled 14 with respect to the Makler 12. Therewith a latching of the container 26 to the feed opening of the deep jolt ramming machine, for example to a charge lock 18, not shown in greater detail here, occurs without problem and in particular also during the running operation of the sinking or boring unit, without its standing still in regard to its upwards and downwards movement as necessary for forming of the column.

By the provision of the cantilever beam 20 at the upper end of the sled 14 it is possible to extend the here not shown guide rails for the sled 14 up to the upper end of the Makler 12, so that the maximal length thereof can be employed as the guide-way or runway for the sled 14. In the upper end position the cantilever beam 20 projects upwardly above the Makler 12. The given length of the Makler 12 can thus produce much longer columns, as compared to the state of the art devices described in the introductory portion.

For filling up the container 26 this is lowered to the ground 100. In this position it must be ensured with suitable measures that the container 26 no longer moves relative to the sled 14. This can be achieved in a simple manner thereby, that the rope winch is switched to no power. This corresponds to a triggering of a so called free fall. In this operating condition no pull forces are conveyed via the rope 24, so that in the case of an upward movement of the sled 14 the rope 24 essentially is pulled from the rope winch 22 in an amount corresponding to the displacement movement of the sled 14. In the case of a downward movement of the sled 14 slack is produced in the rope 24, which respectively according to the traveled length can lead to the result that sections of the rope 24 come to rest upon the ground 100. Insofar as this should be prevented, an automatic rollup can be provided in a known manner on the rope winch 20 which guarantees a pre-tensioning of the rope 24 even in the case of a downwardly directed movement of the sled 14.

From the preceding it can be seen, that by the surprisingly simple inventive concept the production of a material column is possible without necessitating an interruption period for resupply.

A further characteristic of the invention lies in the realization of the double acting feed or supply lock 18 which then comes to use, when the construction of the material column should occur under positive pressurization. In this case a positive pressurization exists continuously in the deep jolt ramming machine 16, even during the material charging, at the tip of the material conveyor conduit 17, which is built up and maintained by a here not shown pressurized air supply.

The feed lock 18 is so conceived, that it can be closed off pressure tight, on the one hand, against the material conveyor conduit 17 with its lock door 21 and, on the other hand, with respect to the environment in the area of a charge or feed opening 19. For the duration of the charging or feeding with fill material via the container 26 the lock door 21 is tightly closed so that the forming of the material column with maintenance of the desired positive pressure can continue. As soon as the container 26 is emptied, the feed opening 19 is closed pressure tight and subsequently the lock door 21 to the deep jolt ramming machine 16 is opened, so that the material can flow therethrough. Therewith the material is charged through under maintenance of the increased pressure level in the material conveyor conduit 17, and an interruption of the process or a blending in of the earth by entering into the material conveyor conduit 17 does not occur.

A supplemental, here not represented, pressure supply for the feed lock 18 makes possible a build up of pressure independent of the deep jolt ramming machine 16, so that the connection between feed lock 18 and deep jolt ramming machine 16 can be opened without pressure differential. Even the otherwise short duration pressure drop, which occurs as a result of the pressure equalization with the supply chamber 18, does not occur.

Depending upon configuration the receiving volume or capacity of the charge or feed lock 18 can be selected to be greater than the conveyor volume of the container 16, so that a type of intermediate storage tank results, which makes possible a further de-coupling between material supply and column production.

In practice it has been shown, that by the employment of the feed lock 18 a time saving of approximately 3 to 5 minutes per material column can be realized. This corresponds to a relative time saving of approximately 10%.

What is claimed is:

1. A device for construction of material columns in the ground, comprising:

a framework (12), a sled (14) movably guided on the framework (12) for manipulating a conveyor system, said conveyor system comprising at least a deep jolt ramming machine (16) and a material conveyance conduit (17), and a cantilever beam (20) supported by the framework (12) with a winch (22) for manipulating a container (26) with which material is charge-wise conveyed to the conveyor system, wherein the container (26) is synchronized with and moveable relative to the sled (14).

2. The device according to claim 1, wherein the cantilever beam (20) is fixedly coupled and displaceable with the sled (14).

3. The device according to claim 2, wherein the cantilever beam (20) is secured to the sled (14).

4. The device according to claim 3, wherein when the sled (14) is in its uppermost position on the framework (12) the cantilever beam (20) projects upwardly above the framework (12).

5. The device according to claim 4, wherein the winch (22) can be switched to no-power or essentially no-power, as long as the container (26) rests upon the ground (100).

6. The device according to claim 1, wherein the sled (14) or the conveyor system has an associated upper end stop for the container (26), and wherein the device further comprises a device for limiting the pull force of the winch (22) in such a manner, that the container (26) filled with material is driven up to the upper end stop and is held there at least during the duration of the feeding of the conveyor system.

7. The device according to claim 1, including a governing device acting upon the winch in such a manner that the container (26) filled with material is lifted and can be maintained at least during the duration of the feeding or charging of the conveyor system within a tolerance band width between an upper and a lower end position relative to the sled.

8. The device according to claim 7, wherein said band width between said upper and lower end position is between 0.1 meter and 0.3 meter.

9. The device according to claim 1, wherein said container (26) is guided on rails on the framework (12).

10. The device according to claim 9, wherein said container is guided on said rails via rollers.

11. The device according to claim 1, further comprising a charge lock (18) at the upper end of the material conveyance conduit (17), said charge lock (18) provided with a pressure-tight connection between the charge lock (18) and material conveyance conduit (17), and adapted for providing a pressure-tight connection between the charge lock (18) and the environment in the area of the charge opening (19).

12. The device according to claim 11, wherein the charge lock (18) receives pressurized air from a source independent of the material conveyance conduit (17).

13. The device according to claim 11, wherein the charge lock (18) is formed as a tank with a capacity equal to or greater than the conveyance volume of the container (26).

14. The device according to claim 13, wherein the capacity of the tank (18) corresponds to the cumulative material volume of the material column to be produced.

15. A device for construction of material columns in the ground comprising;

a framework (12), a sled (14) movably guided on the framework (12) for manipulating a conveyor system, said conveyor system comprising at least a deep jolt ramming machine (16) and a material conveyance conduit (17), and a cantilever beam (20) supported by the framework (12) with a winch (22) for manipulating a container (26) with which material is charge-wise conveyed to the conveyor system, wherein the container (26) is synchronized with and moveable relative to the sled (14), and wherein said columns are packed columns or drains.

* * * * *